US005863019A

United States Patent [19]

Rose et al.

[11] Patent Number: 5,863,019

[45] Date of Patent: Jan. 26, 1999

[54] ELONGATED POSTER GRIPPING DEVICE

[75] Inventors: Sidney Rose; Michael S. Hoffman, both of Marblehead; Alan L. Stenfors, Scituate, all of Mass.

[73] Assignee: Rose Displays, Ltd.

[21] Appl. No.: 741,972

[22] Filed: Oct. 31, 1996

Related U.S. Application Data

[63] Continuation-in-part of Ser. No. 372,814, Dec. 23, 1994, Pat. No. 5,718,402.

[51] Int. Cl.[6] ..... A47G 1/17

[52] U.S. Cl. ..... 248/205.3; 248/316.7; 40/658

[58] Field of Search ..... 248/205.3, 316.7, 248/317, 231.81, 229.26, 229.17, 488, 490, 316.5, 231.51, 74.2; 40/618, 658, 617, 642, 656, 666

*Primary Examiner*—Ramon O. Ramirez
*Assistant Examiner*—Willie Berry, Jr.
*Attorney, Agent, or Firm*—Don Halgren

[57] ABSTRACT

The present invention comprises an elongated extruded poster clamp support assembly for the stiff and reliable hanging of a poster or sign therefrom, comprising an elongated planar base having an upper edge and a lower edge, a channel arranged on the upper edge of the planar base, to permit the clamp to be supported, and a pair of elongated legs attached to the channel, the legs arranged to be rotated into a poster holding orientation by movement about a hinge extending from the channel. The legs thereby define two spaced apart pressure strips biased against the base, for the pinching of a poster therebetween. The invention includes an elongated groove arranged as part of the channel, for the receipt of a stiffener rod to help keep flat any poster supported in the clamp.

15 Claims, 2 Drawing Sheets

ELONGATED POSTER GRIPPING DEVICE

This application is a continuation-in-part of application Ser. No. 08/372,814 filed on Dec. 23, 1994, now U.S. Pat. No. 5,718,402.

BACKGROUND OF THE INVENTION

1. Field of the Invention

This invention relates to gripping devices for securing posters or signs.

2. Prior Art

Devices for holding posters and signs are known to those in the art. Retailers need such devices for hanging display cards or signs, from shelves, cases, and ceilings.

Sign holding devices are shown in a number of patents, such as U.S. Pat. No. 3,324,585 to Fredericson which shows a biasable clip, which actually lances the card which it is holding. A biasable panel is disposed in front of the card, but, the card may be damaged by the mere attempt to pull the panel away from the card. A further support clip is shown in U.S. Pat. No. 3,354,564 to Falcone. This holding clip is actually a marking device which carries a plate on its front side thereof. This very thin clip is utilized to fit over the edge of a cup or a bottle, the plate-like disk acting as a marker on the distal end of one of the legs.

In U.S. Pat. No. 3,955,296 to Kapstad, there is shown a zig-zag clip having a pair of angled tongues arranged to bias against a connecting member so as to engage the device onto a wall of a basket or the like. U.S. Pat. No. 4,341,028 to Brown, shows a card holding clip, one side of which is adaptable to be disposed about a vertical rod. U.S. Pat. No. 4,566,183 to Greenberger, shows a self attachable clip having a forward lip which defines in cross-section, a generally J-shape to the clip. The clip has a rear portion which engages a particular channel groove which may be found on the edge of a shelf. U.S. Pat. No. 4,882,862 to Salbsky, Sr., shows a clip for mounting price cards upon container edges. This clip has a pair of legs, each of which are arranged in a curvilinear fashion. A clip is arranged to fit onto the top of a bowl.

The prior art appears to be limited as to its versatility, as well as its being potentially harmful to the sign or poster that it may be carrying or it may be difficult for the user of such a clip, to control. Other limitations of the prior art, don't always hold the sign in a straight manner, or permit the sign itself to be held in a straight manner. Other shortcomings of the prior art, include hinges which may fail due to their being pressure thereon, or having pressure placed on the poster being carried via the hinge supporting a holder edge.

It is therefore an object of the present invention, to provide an elongated sign holding clip which may be utilized in a variety of configurations and circumstances.

It is a further object of the present invention, to provide a clip for holding signs or posters, wherein the clip will permit the user to engage a sign or poster with a clip, in a fast and simple manner, without damaging that sign or poster.

It is yet a further object of the present invention, to provide a clip for holding signs or posters, wherein that clip may be made to hold that sign or poster in a longitudinally rigid manner, whether that poster is wider or narrower than the clip, and which clip may hold any thickness poster from about 5 mils thick to about 100 mils, without the need for adjustment. It is yet still a further object of the present invention, to provide a clip for holding signs or posters, where portions of the clip which pinch the poster therebetween, do not put any strain or pressure on the hinge of that particular device once that clip is locked in place.

BRIEF SUMMARY OF THE INVENTION

The present invention comprises an elongated, extruded clip for holding cards or posters or the like. This improved elongated, extruded clip may be made in length of from about 15 cm to about 250 cm long or longer.

The extruded clip of the present invention, has a planar backing base with a lowermost edge. The planar backing base has an uppermost edge which has, co-extruded therewith, a support channel thereon. The support channel is comprised of a generally U-shaped first channel wall, and a generally U-shaped second channel wall. The first channel wall and the channel wall are opposed to one another each having a distal edge which is spaced apart from its opposed edge.

The first channel wall has a lowermost side which includes a portion of a stiffener receiving groove. The stiffener receiving groove is preferably of generally circular cross-section. A slot is arranged across the uppermost portion of the circular receiving groove. The lowermost edge of the second channel wall is unitary with and joins a portion of the stiffener receiving groove. The walls of the stiffener receiving groove also have a unitarily attached support arm extending therefrom. The support arm is in a general J-shaped, cross-sectional configuration. The distalmost end of the generally J-shaped support arm has a pressure lip thereat. A flexible living hinge, of thinner cross-section, is co-extruded with the generally J-shaped support arm a spaced distance from the distalmost pressure lip. The hinge rotatively supports a first pressure leg and a second pressure leg. The first pressure leg and the second pressure leg each lie in respective planes which are disposed at an angle of about 90 degrees with respect to one another. The first pressure leg and the second pressure leg are joined to one another at a web of material defined as a pressure trough. The living hinge mates with the second pressure leg at one side edge of the pressure trough, and a slide edge is unitarily attached to and meets with the other second edge of the pressure trough and the uppermost portion of the first pressure leg. A release lip is unitarily attached to and extends at an angle of about 90 degrees with respect to the distalmost edge of the second pressure leg.

The entire clip assembly is extruded in a common die/tool mold, although it is also contemplated that several extrusions may be joined together to form this assembly.

In operation of the present extruded clip, a stiffener rod may be arranged in the stiffener receiving groove adjacent to the support channel, so as to minimize the likelihood of twisting or curvature of any poster arranged within the extruded clip. The support channel is arranged to receive the lowermost portion of an "I" shaped carrier, on which the extruded clip is to be attached.

In arranging a poster or sign within the extruded support clip, that sign or poster is placed against the planer base, juxtaposed between that planar base and the pressure lip which is spaced apart therefrom. The first pressure leg and second pressure leg are pivoted about the webbed hinge which supports the first pressure leg and the second pressure leg with regard to the pressure lip. By rotating that leg assembly about the hinge, the slide edge comes between the pressure lip and the planar base, so as to bend the hinge from one direction, to an opposite direction, to permit the pressure lip to engage the webbed pressure trough there adjacent. The first pressure leg thereby sweeps between the distal edge of the pressure lip, and the planar base, so as to engage the poster or sign therebetween. Continued rotation of the leg assembly brings the second pressure leg into contact with the surface of the poster or sign, and further adjusts the first pressure leg also into snug holding engagement against the sign or poster against the planar base.

The relatively rigid J-shaped support arm with its distalmost pressure lip, thereby presses against the pressure trough, to distribute a biasing force against the poster or sign by virtue of its first and second pressure leg being biased thereagainst. No pressure or exertion is thereafter maintained on the living hinge because the pressure is taken up through the pressure lip through the pressure trough and distributing it to both the first and second pressure legs. Thus, a poster or sign is held against the planar base by two elongated pressure strips, comprised of the first and second elongated pressure legs. The sign may be held in a planar manner by virtue of the stiffener member disposed within the stiffener receiving groove at the upper side of the planer base.

In order to release the bias from the poster of sign and permit the sign to be removed from the planar base, the release lip is engaged manually by a user thereof, so as to pivot the leg assembly about the living hinge adjacent to the J-shaped support arm.

Thus, an elongated poster or sign holding clip arrangement is shown which may be reusable by virtue of its pivotal legs attached to a hinge assembly, which hinge assembly may have many multiple uses, because there is no strain thereon after the biasing leg assembly is fully engaged, and the support arm presses against the web pressure trough between the legs thus eliminating any residual forces on its hinge which is supporting the two together.

The invention thus includes an elongated extruded poster clamp support assembly for the stiff and reliable hanging of a poster or sign therefrom, comprising: an elongated planar base having an upper edge and a lower edge, a channel arranged on the upper edge of the planar base, to permit the clamp to be supported by a carrier, an arrangement of first and second elongated legs pivotably attached to the channel by an elongated hinge arranged therebetween, the legs arranged to be rotated into a poster holding orientation from a spaced away orientation, by pivoting movement about the hinge, the legs thereby defining two spaced apart pressure strips biased against the base, for the pinching of a poster therebetween. The elongated extruded poster clamp support includes an elongated groove arranged as part of the channel, the groove arranged for the tight fitting receipt of a stiffener rod therewithin, to help keep the clamp straight and any poster supported in the clamp, flat. A rigid elongated webbed trough is disposed between the elongated legs, the trough comprising a bridge which receives any biasing forces from the channel pressing the legs against the base with a poster therebetween. The legs and the hinge are joined to the channel by a rigid elongated support arm which is co-extruded therewith. The support arm is of generally "J" shape in cross-section to permit the legs to be pivoted away from the base, and permit pressure to be applied to the legs and any poster therebbetween. The support arm includes an elongated pressure lip on a distal edge thereof, the pressure lip arranged to apply pressure to the webbed trough bridging the legs, and to remove any pressure upon the hinge thereadjacent. The hinge and the pressure lip each extend off of the distal edge of the support arm. The elongated slide edgeis arranged at the proximal end of the first leg to permit both of the legs to be pivoted around the hinge and have the pressure lip engage the webbed trough bridging the legs. An elongated release lip is arranged at the distal end of the second leg, to permit both of the legs to be pivoted around the hinge and away from receipt of pressure from the pressure lip and any poster between the legs and the base of the clamp. The hinge is curved in one direction when the legs are holding a poster to the base, and the hinge is curved in an opposite direction when the legs are pivoted away fron the base in a non-poster engaging orientation.

The invention includes a method of supporting a poster in a flat condition on a carrier, comprising the steps of extruding a planar base having a first edge and a second edge, with a carrier receiving channel attached to the second edge, arranging a support arm on the carrier, the support arm having a pair of legs hingedly connected thereto, placing a poster between the distal end of the support arm and the planar base, and pivoting the legs about the distal end of the support arm and about the hinge, to bring the legs into contact with the poster and pressure against the planar base. The method includes the step of pressing a pair of parallel edges of the distal ends of the legs against the poster to hold the poster in place, and lifting an elongated release lip attached to the distal edge of one of the legs, so as to permit the pivoting of both of the legs around the hinge and off of the poster. The method includes the steps of reversing the shape of the hinge from a curve in a first direction, to a curve in an opposite direction, inserting a rod in a receiving groove adjacent the channel to maintain the clamp and a poster therein, in a flat orientation, sliding the channel onto the carrier for support of the clamp and display of the poster.

BRIEF SUMMARY OF THE DRAWINGS

The objects and advantages of the present invention will become more apparent, when viewed in conjunction with the following drawings, in which.

DESCRIPTION OF THE PREFERRED EMBODIMENTS

The present invention comprises an elongated, extruded clip 10 for holding cards or posters "P", or the like. This improved elongated, extruded clip 10 may be made in length of from about 15 cm to about 250 cm long or longer.

Figure 3:
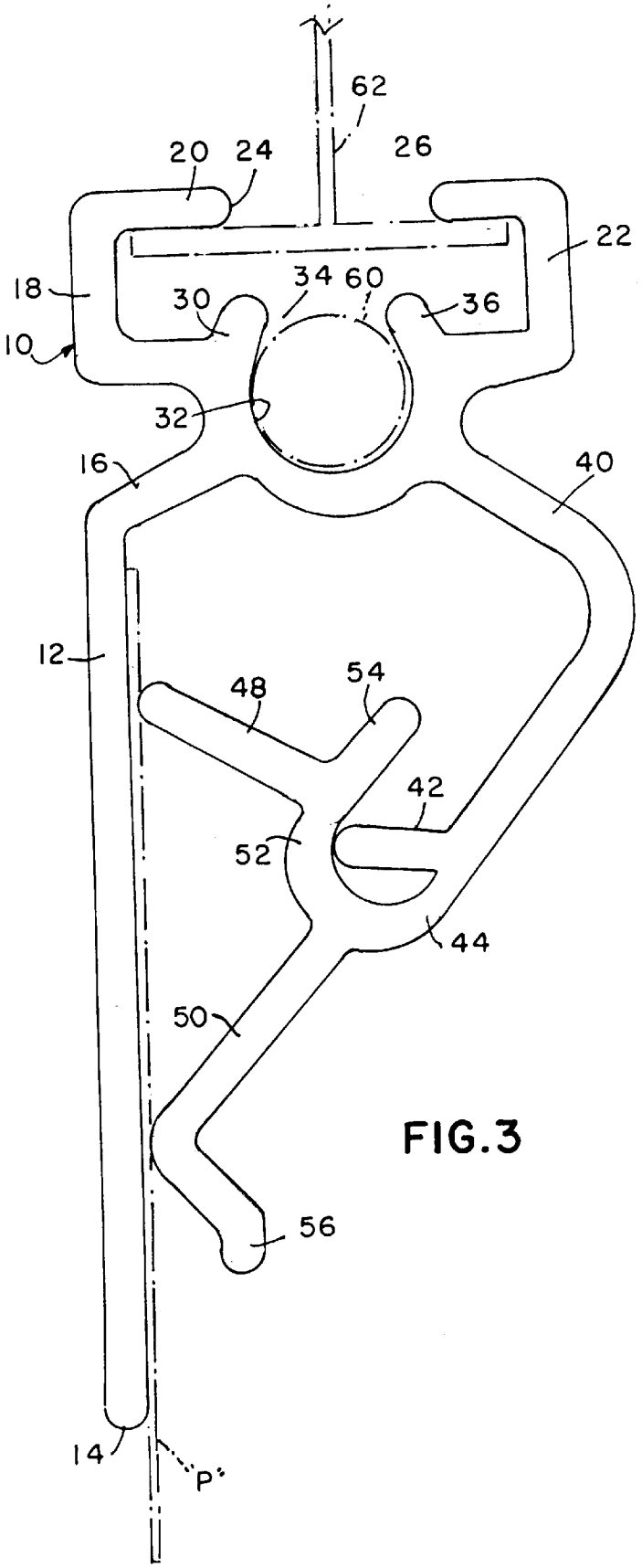
FIG. 3 is an end view of the extruded clip of the present invention showing a sign or poster engaged and supported therewith.

The extruded clip 10 of the present invention, has a planar backing base 12 with a lowermost edge 14. The planar backing base 12 has an uppermost edge 16 which has, co-extruded therewith, a support channel 18 thereon. The support channel 18 is comprised of a generally U-shaped first channel wall 20 and a generally U-shaped second channel wall 22. The first channel wall 20 and the second channel wall 22 are opposed to one another, each having a distal edge 24 and 26 respectively, which are spaced apart from one another, as shown in FIG. 3.

The first channel wall 20 has a lowermost side 30 which includes a portion of a stiffener receiving groove 32. The stiffener receiving groove 32 is preferably of generally circular cross-section. A slot 34 is arranged across the uppermost portion of the circular receiving groove 32. The lowermost edge 36 of the second channel wall 22 is unitary with and joins a portion of the stiffener receiving groove 32. The walls of the stiffener receiving groove 32 also have a unitarily attached support arm 40 extending therefrom. The support arm 40 is in a general J-shaped, cross sectional configuration, as shown in FIG. 3. The distalmost end of the generally J-shaped support arm 40 has an elongated pressure lip 42 thereat. An elongated flexible living hinge 44, of thinner cross-section, is co-extruded with the generally J-shaped support arm 40 a spaced distance from the distalmost pressure lip 42. The hinge 44 rotatively supports a first pressure leg 48 and a second pressure leg 50. The first pressure leg 48 and the second pressure leg 50 each lie in respective planes which are disposed at an angle of about 90 degrees with respect to one another, as may be seen in FIG. 3. The first pressure leg 48 and the second pressure leg 50 are joined to one another at a rigid web of material defined as a pressure trough 52. The living hinge 44 mates with the second pressure leg 50 at one side edge of the pressure trough 52, and a slide edge 54 is unitarily attached to and meets with the other second side edge of the pressure trough 52 and the proximalmost portion of the first pressure leg 48. An elongated release lip 56 is unitarily attached to and extends at an angle of about 90 degrees with respect to the distalmost edge of the second pressure leg 50.

The entire clip assembly 10 is extruded in a common die/tool mold, although it is contemplated in an alternative embodiment, that several extrusions may be joined together to form this assembly 10.

In operation of the present extruded clip 10, a stiffener rod 60 may be arranged in the stiffener receiving groove 32 adjacent to the support channel 18, so as to minimize the likelihood of twisting or curvature of any poster "P" arranged within the extruded clip 10. The support channel 18 is arranged to receive the lowermost portion of an "I" shaped carrier 62, on which the extruded clip 10 is to be attached.

Figure 1:
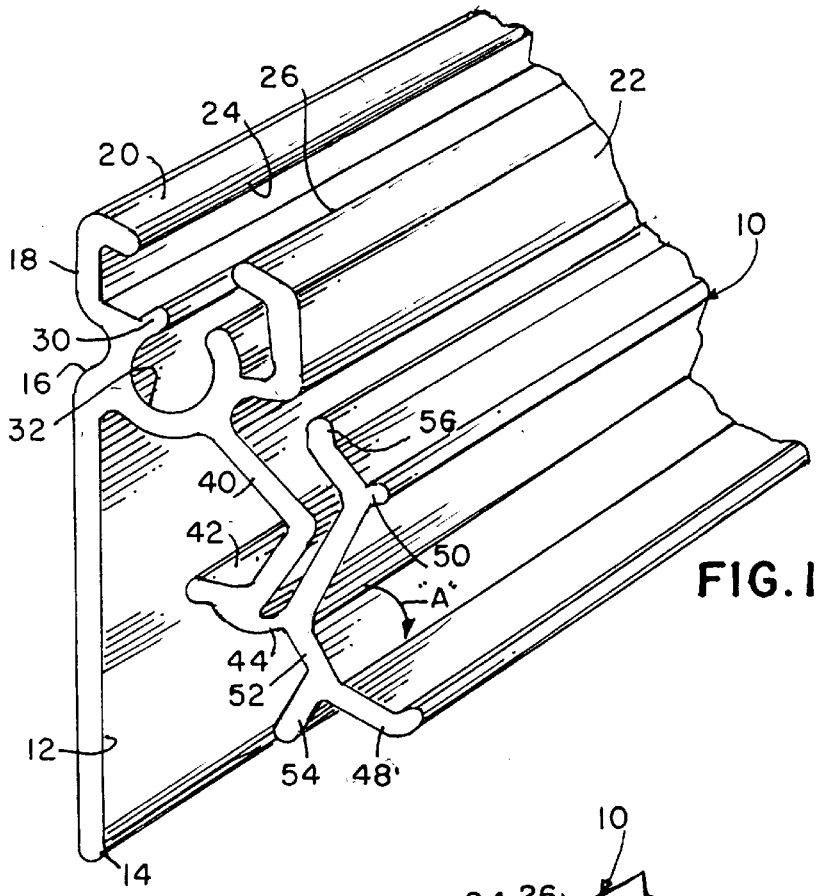
FIG. 1 perspective view of an end portion of the extruded clip constructed according the principles of the present invention, in a first or opened configuration.
Figure 2:
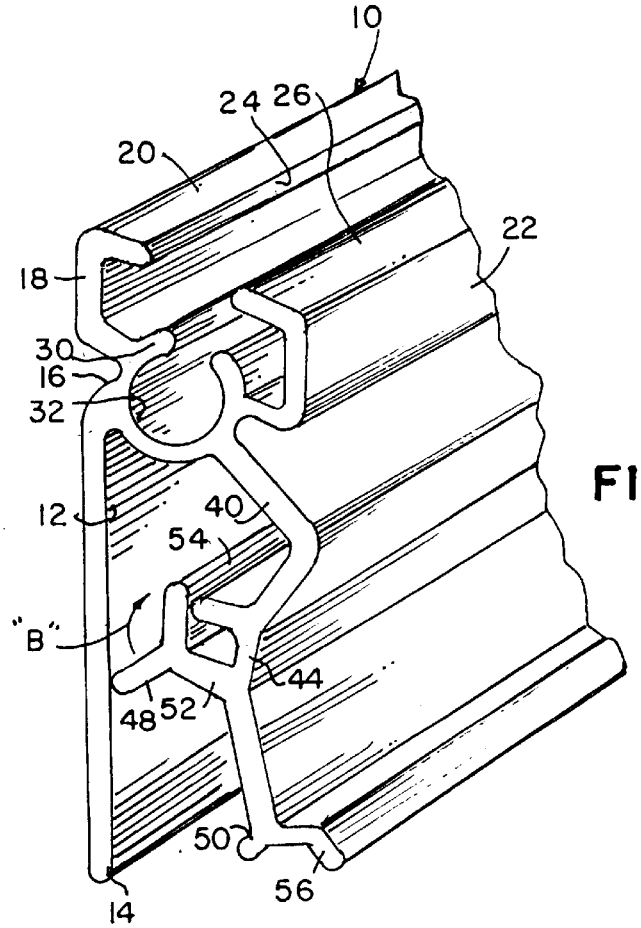
FIG. 2 is a partial, perspective view, similar to that of FIG. 1, showing a leg assembly of the present invention pivoting into a sign engaging orientation.

In arranging a poster "P" or sign within the extruded support clip 10, that sign or poster "P" is placed against the planar base 12, juxtaposed between that planar base 12 and the pressure lip 42 which is spaced apart therefrom. The first pressure leg 48 and second pressure leg 50 are pivoted about the webbed hinge 44 which supports the first pressure leg 48 and the second pressure leg 50 with regard to the pressure lip 42. By rotating that leg assembly 48 and 50 about the hinge 44, as shown by the arrows "A" and "B" in FIGS. 1 and 2 respectively, the slide edge 54 comes between the pressure lip 42 and the planar base 12, so as to bend the hinge 44 from one direction as shown in FIG. 1, to an opposite direction, as shown in FIG. 2, to permit the pressure lip 42 to engage only the webbed pressure trough 52 thereadjacent. The first pressure leg 48 thereby sweeps between the distal edge of the pressure lip 42, and the planar base 12, so as to engage the poster "P" or sign therebetween. Continued rotation of the legs 48 and 50 as shown in FIG. 2, also brings the second pressure leg 50 into contact with the surface of the poster "P" or sign, and further adjusts the first pressure leg 48 also into snug holding engagement against the sign or poster "P" against the planar base 12, as shown in FIG. 3.

The relatively rigid J-shaped support arm 40 with its distalmost pressure lip 42, thereby presses against the pressure trough 52, to distribute a biasing force against the poster "P" or sign, by virtue of its first and the second pressure legs 48 and 50 being biased thereagainst. No pressure or exertion is thereafter maintained on the living hinge 44, thereby extending its life, because the pressure is taken up through the pressure lip 42, only through the pressure trough 52 and distributing it to the first and second pressure legs 48 and 50. Thus, a poster "P" or sign is held against the planar base 12 by two elongated, parallel pressure strips, comprised of the first and second elongated pressure legs 48 and 50. The sign "P" may be held in a planar manner by virtue of the stiffener member 60 disposed within the stiffener receiving groove 32 at the upper side of the planer base 12.

In order to release the bias from the poster "P" or sign and permit the sign to be removed from the planar base 12, the release lip 56 is engaged manually by a user thereof, so as to pivot the leg assembly back around the living hinge 44 adjacent to the J-shaped support arm 40.

Thus, an elongated poster or sign holding clip arrangement is shown which may be reusable by virtue of its pivotal legs attached to a hinge assembly, which hinge assembly may have many multiple uses, because there is no strain thereon after the biasing leg assembly is fully engaged and the support arm presses against the web pressure trough between the legs thus eliminating any residual forces on its hinge supporting the two together.

We claim:

1. An elongated extruded poster clamp support assembly for the stiff and reliable hanging of a poster or sign therefrom, comprising:

an elongated planar base having an upper edge and a lower edge;

a channel arranged on said upper edge of said planar base, to permit said clamp to be supported by a carrier;

an elongated groove arranged as part of said channel, said groove arranged for the tight fitting receipt of a stiffener rod therewithin, to help keep said clamp straight and any poster supported in said clamp, flat; and an arrangement of first and second elongated legs pivotably attached to said channel by an elongated hinge arranged therebetween, said legs arranged to be rotated into a poster holding orientation from a spaced away orientation, by pivoting movement about said hinge, said legs thereby defining two spaced apart pressure strips biased against said base, for the pinching of a poster therebetween.

2. The elongated extruded poster clamp support as recited in claim 1, including:

a rigid elongated webbed trough disposed between said elongated legs, said trough comprising a bridge which receives any biasing forces from said channel pressing said legs against said base with a poster therebetween.

3. The elongated extruded poster clamp as recited in claim 1, wherein said legs and said hinge are joined to said channel by a rigid elongated support arm which is co-extruded therewith.

4. The elongated extruded poster clamp as recited in claim 2, wherein said support arm is of generally "J" shape in cross-section to permit said legs to be pivoted away from said base, and permit pressure to be applied to said legs and any poster therebbetween.

5. The elongated extruded poster clamp as recited in claim 3, wherein said support arm includes an elongated pressure lip on a distal edge thereof, said pressure lip arranged to apply pressure to said webbed trough bridging said legs, and to remove any pressure upon said hinge thereadjacent.

6. The elongated extruded poster clamp as recited in claim 5, wherein said hinge and said pressure lip each extend off of said distal edge of said support arm.

7. The elongated extruded poster clamp as recited in claim 5, including an elongated slide edge arranged at the proximal end of said first leg to permit said legs to be pivoted around said hinge and have said pressure lip engage said webbed trough bridging said legs.

8. The elongated extruded poster clamp as recited in claim 5, including an elongated release lip arranged at the distal end of said second leg, to permit said legs to be pivoted around said hinge and away from receipt of pressure from said pressure lip and any poster between said legs and said base of said clamp.

9. The elongated extruded poster clamp as recited in claim 8, wherein said hinge is curved in one direction when said legs are holding a poster to said base, and said hinge is curved in an opposite direction when said legs are pivoted away fron said base in a non-poster engaging orientation.

10. A method of supporting a poster in a flat condition on a carrier, comprising the steps of:

extruding a planar base having a first edge and a second edge, with a carrier receiving channel attached to said second edge;

arranging a support arm on said channel, said support arm having a pair of legs hingedly connected by a hinge thereto;

placing a poster between the distal end of said support arm and said planar base;

pivoting said legs about said distal end of said support arm and about said hinge thereon, to bring said legs into contact with said poster and pressure against said planar base.

11. The method of claim 10, including the step of:

pressing a pair of parallel edges at the distal ends of said legs against the poster to hold the poster in place.

12. The method of claim 11, including the step of:

lifting an elongated release lip attached to the distal edge of one of said legs, so as to permit the pivoting of both of said legs around said hinge and off of the poster.

13. The method of claim 12, including the step of:

reversing the shape of said hinge from a curve in a first direction, to a curve in an opposite direction so as to effect the removal of any pressure on said hinge by said support arm.

14. The method of claim 11, including the step of:

inserting a rod in a receiving groove adjacent said channel to maintain said clamp and a poster therein, in a flat orientation.

15. The method of claim 11, including the step of:

sliding said channel onto a carrier for support of said clamp and display of the poster.

* * * * *